US008061860B2

(12) United States Patent
Weigl, Jr.

(10) Patent No.: US 8,061,860 B2
(45) Date of Patent: Nov. 22, 2011

(54) ILLUMINATING UTENSIL

(76) Inventor: James A. Weigl, Jr., Virginia Beach, VA (US)

( * ) Notice: Subject to any disclaimer, the term of this patent is extended or adjusted under 35 U.S.C. 154(b) by 0 days.

(21) Appl. No.: 12/497,962

(22) Filed: Jul. 6, 2009

(65) Prior Publication Data

US 2010/0005667 A1 Jan. 14, 2010

Related U.S. Application Data

(63) Continuation of application No. 10/941,582, filed on Sep. 15, 2004, now Pat. No. 7,556,392.

(51) Int. Cl.

| | |
|---|---|
| ***F21K 2/00*** | (2006.01) |
| ***F21K 2/06*** | (2006.01) |
| ***F21V 9/16*** | (2006.01) |
| ***B25B 23/18*** | (2006.01) |
| ***F21S 8/00*** | (2006.01) |

(52) U.S. Cl. ..... 362/34; 362/84; 362/120; 362/426; 362/577

(58) Field of Classification Search ..... 362/34, 362/84

See application file for complete search history.

(56) References Cited

U.S. PATENT DOCUMENTS

| | | | | |
|---|---|---|---|---|
| 3,510,643 | A | 5/1970 | File | |
| 3,934,539 | A * | 1/1976 | Little et al. | 116/63 P |
| 4,768,136 | A * | 8/1988 | Tashjian | 362/84 |
| 4,771,724 | A | 9/1988 | Baretz et al. | |
| 4,924,358 | A | 5/1990 | Von Heck | |
| 5,023,761 | A | 6/1991 | de Lange | |
| 5,033,142 | A | 7/1991 | Templeton | |
| D331,889 | S | 12/1992 | Kaplan | |
| 5,279,513 | A | 1/1994 | Connelly | |
| 5,931,383 | A | 8/1999 | Palmer et al. | |
| 5,961,199 | A | 10/1999 | Lee | |
| 5,984,754 | A * | 11/1999 | Freelander | 446/73 |
| 6,062,380 | A | 5/2000 | Dorney | |
| 6,217,187 | B1 * | 4/2001 | Demsko | 362/84 |
| 6,226,917 | B1 | 5/2001 | Sylla et al. | |
| D452,926 | S | 1/2002 | Wu | |
| 6,474,467 | B1 | 11/2002 | Kurdian | |
| 6,523,778 | B2 | 2/2003 | Key et al. | |
| 6,572,244 | B1 | 6/2003 | Clark | |
| 6,619,808 | B1 | 9/2003 | Pelto | |
| 6,675,483 | B2 | 1/2004 | Bond et al. | |
| 6,676,269 | B1 | 1/2004 | Dorney | |
| 6,679,614 | B2 | 1/2004 | Pittman | |
| 6,701,720 | B1 | 3/2004 | Stone et al. | |
| 2001/0004318 | A1 | 6/2001 | Pitts | |
| 2002/0058090 | A1 | 5/2002 | Siddons | |
| 2002/0159244 | A1 | 10/2002 | Plante | |
| 2003/0107882 | A1 | 6/2003 | Pittman | |

(Continued)

FOREIGN PATENT DOCUMENTS

| | | |
|---|---|---|
| EP | 0980906 | 2/2000 |

(Continued)

*Primary Examiner* — James Lee
*Assistant Examiner* — David Makiya
(74) *Attorney, Agent, or Firm* — Lieberman & Brandsdorfer, LLC

(57) ABSTRACT

A utensil that emits light from a handle portion thereof for a limited period of time. The handle portion may be in the form of a chemiluminescent light stick. A head portion of the utensil has a hollow interior proximal end adjacent to a solid distal end. The hollow interior is sized to receive the light stick, with the hollow interior having at least one burr to provide a frictional fit and to hold the received light stick therein.

9 Claims, 6 Drawing Sheets

U.S. PATENT DOCUMENTS

| | | | | |
|---|---|---|---|---|
| 2003/0137826 | A1 | 7/2003 | Nomiyama | |
| 2003/0137827 | A1 | 7/2003 | Bouton et al. | |
| 2003/0147234 | A1 | 8/2003 | Harada et al. | |
| 2003/0176240 | A1 | 9/2003 | Redwine et al. | |
| 2003/0179567 | A1* | 9/2003 | Pelto | 362/34 |
| 2005/0180125 | A1 | 8/2005 | Yu | |
| 2007/0247830 | A1* | 10/2007 | Schrimmer et al. | 362/84 |

FOREIGN PATENT DOCUMENTS

| | | |
|---|---|---|
| EP | 1600690 | 11/2005 |
| WO | 9624007 | 8/1996 |
| WO | 9938422 | 8/1999 |
| WO | 9958898 | 11/1999 |
| WO | 0010646 | 3/2000 |

* cited by examiner

ILLUMINATING UTENSIL

CROSS REFERENCE TO RELATED APPLICATION(S)

The present application is a continuation-in-part patent application claiming the benefit of U.S. patent application Ser. No. 10/941,582, filed on Sep. 15, 2004 and titled "Illuminating Utensil," now pending, which is hereby incorporated by reference.

BACKGROUND OF THE INVENTION

1. Technical Field

This invention relates to a utensil adapted to be illuminated. More specifically, the invention relates to a utensil adapted to receive and hold a chemiluminescent light stick to the utensil.

2. Description of the Prior Art

Chemiluminescent light stick consists of an elongated flexible tube sealed at both ends. Two isolated chemicals are housed within the tube. One of the chemicals is stored in a self-contained glass vial within the tube. Upon breakage of the glass vial, the two chemicals mix resulting in a chemical reaction that creates a cold light for a limited duration.

There are numerous products that invite the use of a chemiluminescent light stick to provide color and illuminating characteristics. Some products are in the form of amusement products, edible compositions, and a variety of other products. For example, U.S. Pat. No. 6,471,364 to Plante discloses a lollipop with a chemiluminescent light stick. The lollipop has a candy portion comprised of an edible composition, and a stick in the form of a chemiluminescent light stick. To illuminate the handle portion of the lollipop, the stick is bent to break an internal barrier of the stick. Another example is found in international application number WO 96/24007 to Diehl, which discloses a stemmed drinking utensil that may be illuminated. The stem of the drinking glass functions as a conduit adapted to receive a chemiluminescent light stick. Prior to inserting the light stick into the conduit of the stem, the light stick is flexed to break an internal barrier, resulting in emission of light. Thereafter, the light stick is inserted into the stem conduit to enable the stem portion of the drinking utensil to emit light.

It is further known in the art to use one or more batteries in conjunction with electronic circuitry to illuminate novelty food items. Examples of such patents include U.S. Pat. No. 4,914,748 to Schlotter et al., U.S. Pat. No. 5,471,373 to Coleman et al., and U.S. Pat. No. 6,135,606 to Fernandez et al. However, there are drawbacks associated with use of electronic circuitry and food items or items that are adapted to come into contact with the food. Some of the drawbacks include cost, safety, and the ability to clean and/or recycle the illuminated item for later use.

Although it is known in the art to apply the use of a chemiluminescent light stick to a drinking utensil and to edible substances in place of electronic circuitry and batteries, there is no teaching in the art to apply the use of a chemiluminescent light stick to utensils in a safe and reliable manner. Accordingly, there is therefore a need for a utensil that emits light for a limited period of time in a safe and economical manner.

SUMMARY OF THE INVENTION

This invention comprises an apparatus and method for illuminating a utensil.

In one aspect of the invention, an apparatus is provided a utensil with a head portion and a releasable handle portion. The head includes a proximal end and a distal end. Similarly, the releasable handle includes a proximal end and a distal end. The proximal end of the head has a hollow conduit with a shape sized to receive the proximal end of the handle with a complementary shape to the hollow conduit. The hollow conduit of the head has an interior surface to contact an exterior surface of the handle. At least one raised edge on the interior surface provides a frictional fit with the handle and to hold the handle within the hollow conduit.

In another aspect of the invention, an apparatus is provided with a detachable utensil head with a proximal end and a distal end, and a chemiluminescent stick with a proximal end and a distal end. The proximal end of the utensil head has a hollow interior section sized to receive the proximal end of the chemiluminescent light stick, and the hollow interior section of the utensil head has at least one burr formed on an interior surface of the utensil head to hold the proximal end of the light stick in the hollow interior section. The proximal end of the chemiluminescent stick is releasably engageable with the proximal end of the detachable utensil head. To form a utensil, the proximal end of the chemiluminescent stick removably inserts into an annular groove of the proximal end of the detachable utensil head.

Other features and advantages of this invention will become apparent from the following detailed description of the presently preferred embodiment of the invention, taken in conjunction with the accompanying drawings.

DESCRIPTION OF THE PREFERRED EMBODIMENT

Overview

A utensil is provided with a handle that emits light. The handle may be in the form of a chemiluminescent light stick having a material that is partially or completely transparent, or partially or completely translucent to enable the light from the light stick to be emitted and visible outside of the conduit. The utensil head includes a proximal end with a hollow interior, and a distal end with a solid form. The hollow interior is sized to receive the light stick, and further includes at least one burr to provide friction hold the light stick in the hollow interior. Upon attachment of the light stick to the utensil head, the light stick forms the handle of the utensil. Similarly, upon expiration of the light stick, or if the user wants a utensil that emits a different color, the light stick may be replaced. The head and handle may be detached with sufficient force to overcome the frictional fit, after which the hollow interior of the utensil head may receive a new light stick. Accordingly, a utensil with a replaceable light source is provided and described herein.

Technical Details

Figure 1:
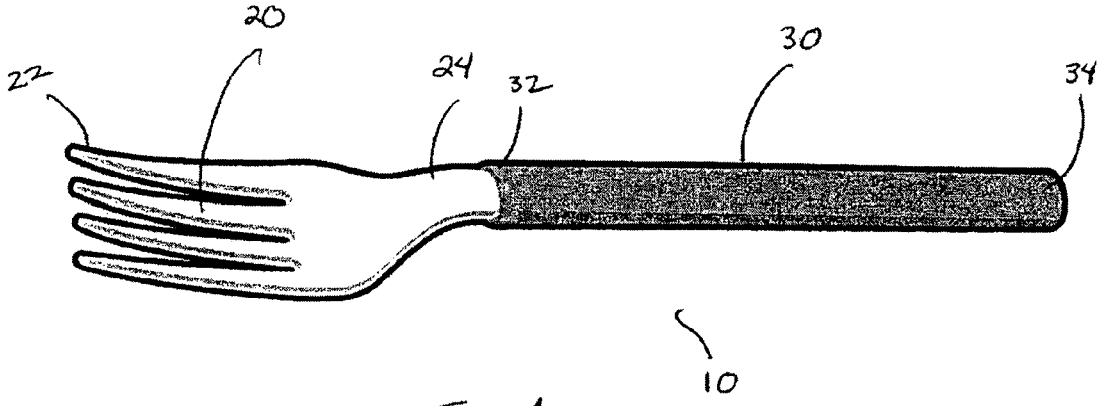
FIG. 1 is a perspective view of a utensil with a light stick as a handle.
Figure 1A:
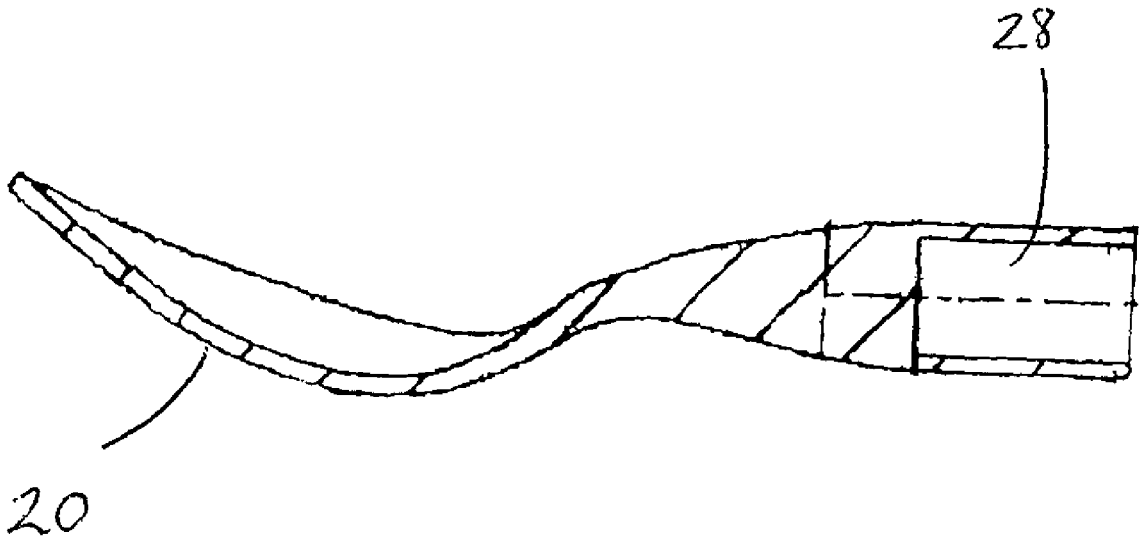
FIG. 1A is a side view of the utensil with a light stick as a handle.

FIG. 1 is a perspective view of an eating utensil (10) in one embodiment of the invention. As shown, the eating utensil is comprised of two primary components, the head (20) and the handle (30). The head has two ends, a proximal end (22) and a distal end (24). Similarly, the handle (30) includes a proximal end (32) and a distal end (34) remote from the proximal end (32), with both ends sealed. The distal end (24) of the head (20) is adapted to receive and engage the proximal end (32) of the handle (30) to form the appearance of a conventional utensil (10). FIG. 1A is a side view of the head (20) with an opening (28) size to receive and engage the proximal end (32) (not shown) of the handle (30) (not shown) to form the appearance of a conventional utensil. The handle (30) and head (20) may be formed as a single cohesive unit (10), or in one embodiment, the handle (30) may be detachable from the head (20), as shown in FIG. 2.

Figure 1B:
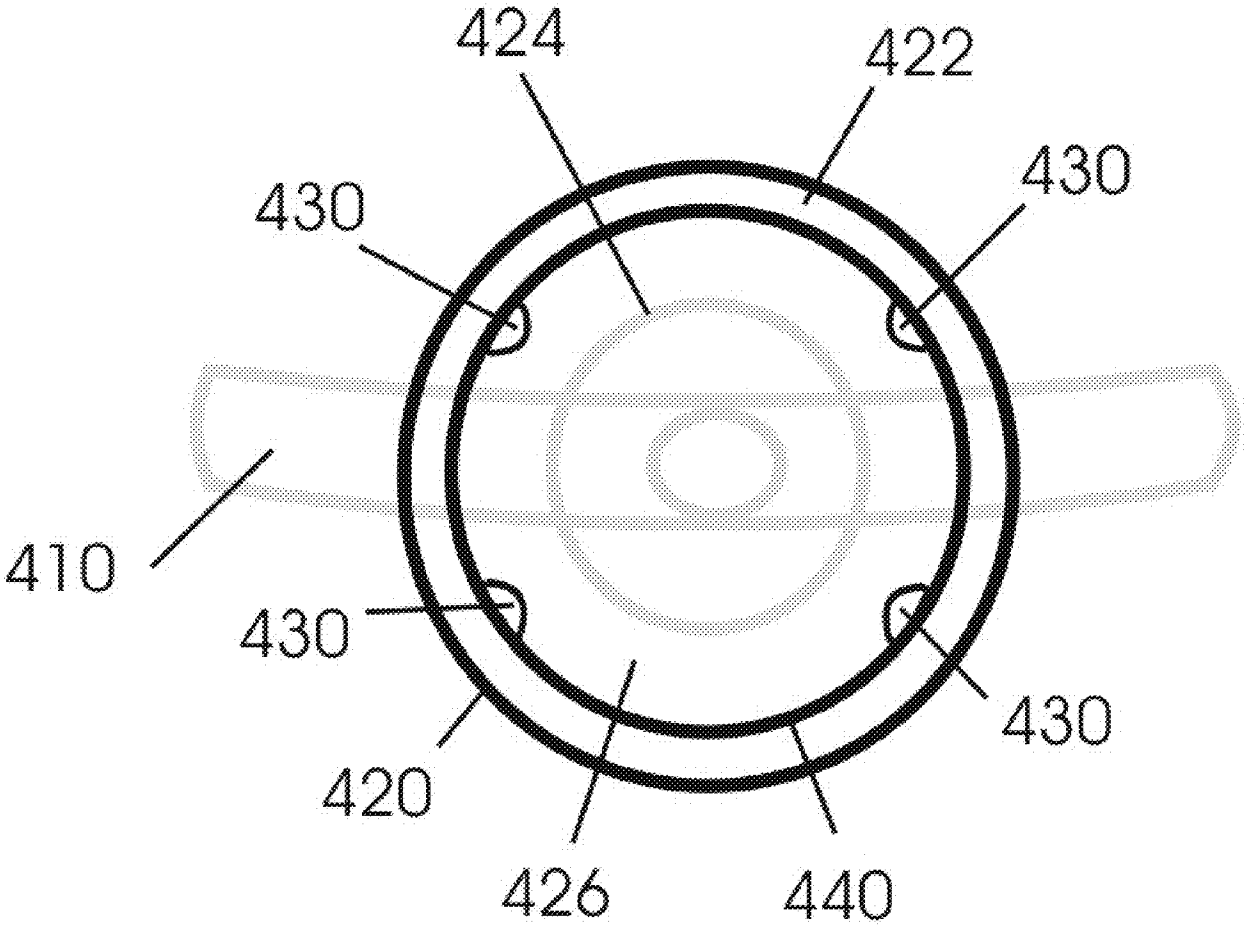
FIG. 1B is a bottom view of the head of the utensil.

FIG. 1B is a bottom view of the head of the eating utensil. As shown, the head (400) is comprises of two components therein, the utensil component (410) and the opening component (420). More specifically, the utensil component (410) is a solid portion of the head that in one embodiment may comprise a functional element, such as the head of an eating utensil or a writing implement. The opening component (420) includes a proximal end (422) and a distal end (424). The distal end (424) is adjacent to the utensil component (410) and forms a closure to the opening component (420). The proximal end (422) includes a hollow portion (426) that forms a passage to receive an object (not shown). To hold the received object, at least one burr (430) is provided on an interior surface (440) of the hollow portion (426). More specifically, the burr (430) is sized to provide friction between the received object and interior surface (440) to hold the object. Once the object is received and held within the hollow portion (426), the received object forms the handle of the utensil. In one embodiment, the burr (430) may come in different shapes and sizes, and as such should not be limited to the shape and size shown herein. Similarly, in one embodiment, the hollow portion (426) may include more than one burr (430) positioned on the interior surface (440). Furthermore, the burr (430) is configured to hold the chemiluminescent light stick in the hollow portion (426) so as not to rupture the skin of the received chemiluminescent light stick. Accordingly, the hollow portion (426) is sized to receive a light stick, with the burr (430) functioning as a frictional element to hold the received light stick therein.

Once the chemiluminescent light stick is received by the hollow portion (426), it forms the handle of a utensil. In one embodiment, the formed utensil is not a permanent attachment. The light stick may be detached from the hollow portion (426) of the utensil through a pull action with sufficient force to overcome the frictional fit provided by the burr (430).

Figure 2:
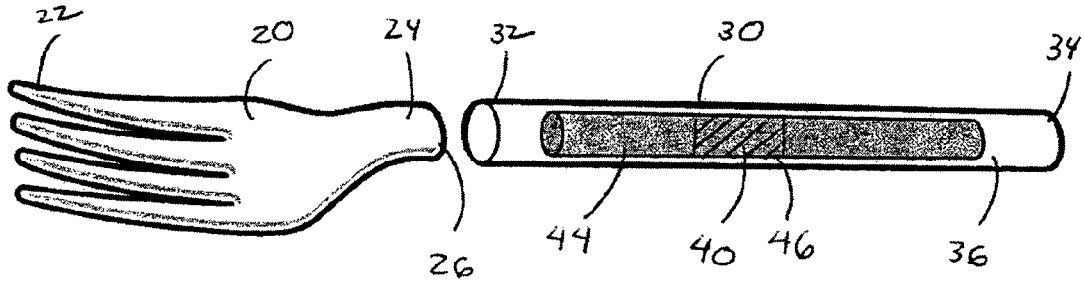
FIG. 2 is a perspective view of a utensil with a removable light stick as a handle.

In the embodiment shown in FIG. 2, the distal end (24) of the head (20) may come in the form of a cap (26) sized to receive and hold the proximal end (32) of the handle (30). Similarly, the distal end (24) of the head (20) may include an annular groove (26) to hold the proximal end (32) of the handle (30). Accordingly, the head (20) and the handle (30) are two primary elements that securely form a utensil (10).

As shown in FIGS. 1 and 2, the handle (30) is in the form of a chemiluminescent light stick that is adapted to emit a light and provide an illuminated utensil. The handle (30) is an elongate element that extends from the distal end (24) of the head (20). The chemiluminescent light stick has a flexible or near flexible property. The light stick (30) is sealed at both the proximal and distal ends (32) and (34) to form a hollow interior (36) with a frangible enclosure (40) fitted within the hollow interior (36). The provision of the frangible enclosure (40) essentially divides the hollow interior (36) into two compartments. The hollow interior (36) contains a first chemical (44), and the frangible enclosure (40) contains a second chemical (46). The first and second chemicals (44) and (46) are selected for the property of forming a chemiluminescent reaction when combined. In general, upon bending the light stick (30), the frangible enclosure (40) will break thereby forcing the two chemicals (44) and (46) to mix and react. Following reaction of the chemicals, the light stick will emit light for a limited duration. A person may flex the light stick (30) to initiate the chemical reaction that provides the illumination prior to or following the process of attaching the light stick (30) to the utensil head (20). In an example where the light stick (30) is flexed prior to securing the light stick (30) to the utensil head (20), following the chemical reaction, the proximal end (32) of the light stick (30) is attached to the distal end of the utensil head (24). Alternatively, the light stick (30) may be flexed following attachment to the utensil head (20). In either situation, the light stick (30) has sufficient strength to provide support for use as a handle of a utensil. Accordingly, the handle of the utensil is in the form of a light stick that is either illuminated or adapted to emit light following an internal chemical reaction.

Figure 3:
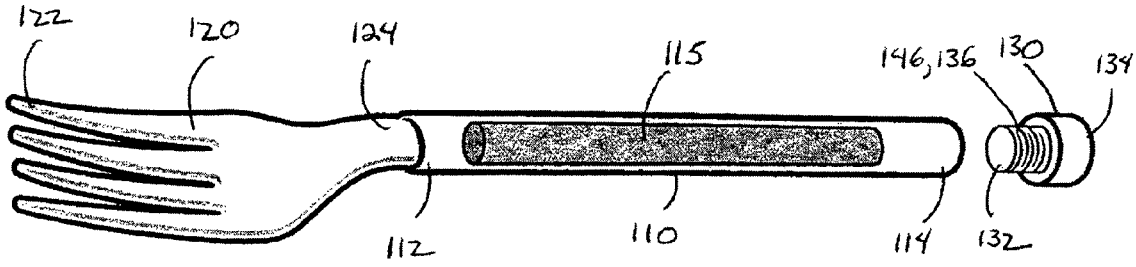
FIG. 3 is a perspective view of a utensil with a handle in the form of a conduit with a closing element.

FIG. 3 is a perspective view of another embodiment for modifying a utensil (100) to include a handle (110) adapted to emit light. The utensil (100) includes a head (120) with a proximal end (122) and a distal end (124), and an elongated handle (110) with a proximal end (112) and a distal end (114). The proximal end (112) of the handle (110) is adjacent to the distal end (124) of the head (120). The head (120) and handle (110) may be detachable as shown in FIG. 2, or they may be formed as a single cohesive unit. In either formation, the handle (110) is in the form of a chemiluminescent light stick or conduit that is a sized to receive a chemiluminescent light stick (115). The conduit may be flexible so that the conduit, i.e. handle (110), with the light stick (115) therein, and may be flexed to initiate the chemical reaction. Alternatively, the conduit (110) may have a stiffer characteristic that requires the light stick (115) to be flexed prior to insertion in the conduit (110). In the embodiment employing the conduit (110), the light stick (115) is inserted into the conduit and secured therein with a closing element (130). Accordingly, the utensil (100) includes a head (120), and a handle (110) in the form of a conduit sized to receive a chemiluminescent light stick (115).

Figure 4:
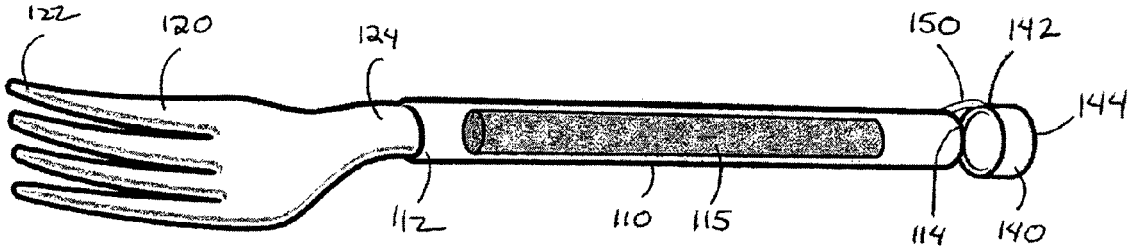
FIG. 4 is a perspective view of a utensil with a handle in the form of a conduit with an alternative closing element.
Figure 5:
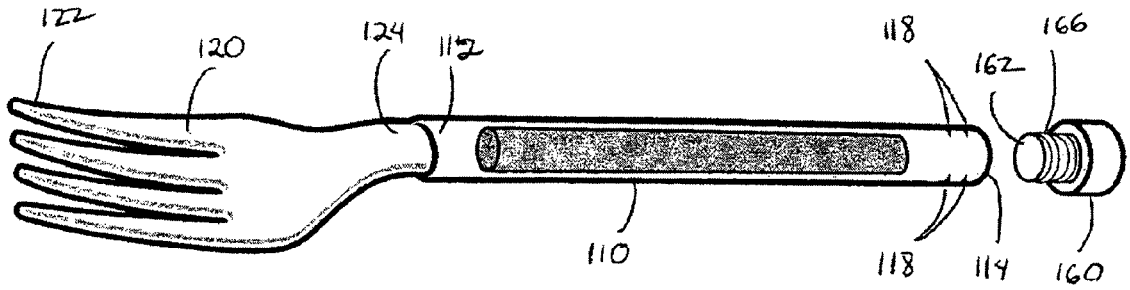
FIG. 5 is a perspective view of a utensil with a handle in the form of a conduit with an alternative closing element.

As shown in FIG. 3, the closing element (130) has a proximal end (132) and a distal end (134), with the proximal end (132) of the closing element (130) having a threaded exterior surface (136), and the circumference of the distal end (134) being greater than the circumference of the distal end of the conduit (114) to enable removal of the closing element (130) from the conduit (110). Similarly, the distal end (114) of the conduit (110) has a threaded interior surface (not shown) to receive the threaded exterior surface (136) of the closing element (130). In another embodiment, the interior surface of the closing element (130) may be threaded to be received by a threaded exterior surface of the conduit (110). Furthermore, the closing element (130) may be in the form of a cap (140), as shown in FIG. 4. The cap may be a solitary unit (140) that is remote from the conduit (110), as shown in FIG. 3. In one embodiment, the cap (140) may be attached to the distal end (114) of the conduit (110) by a tether (150) to prevent loss of the cap at such time as it is not secured to the distal end (114) of the conduit (110). The cap (140) has a proximal end (142) and a distal end (144), with the proximal end (142) having an extension (146) with an external circumference less than an internal circumference of the distal end (114) of the conduit (110) so that the proximal end of the cap is received in the distal end of the conduit. Alternatively, the proximal end (142) of the cap (140) may have a circumference greater than the circumference of the distal end (114) of the conduit (110) so that the proximal end of the cap receives the distal end of the conduit. In one embodiment, the internal surface area of the distal end (114) of the conduit (110) may one or more projections (118), as shown in FIG. 5, and the external surface of the proximal end (162) of the cap (160) may include one or more grooves (166). Upon insertion of the cap (160) into the distal end (114) of the conduit (110), the groove(s) (166) would be received and held in place by the projection(s) (118). To illuminate the handle (110) of the utensil, the light stick may be flexed to initiate the chemical reaction and then inserted into the conduit (110) followed by attachment of the cap (130) or (160) to the distal end (114) of the conduit (110). In one embodiment, the conduit (110) may have sufficient flexibility to enable a person to insert the light stick into the conduit (110) and close the distal end (114) of the conduit (110) with the cap (130) or (160) prior to initiating the chemical reaction of the light stick. The person may flex the conduit (110) with the light stick ( ) therein. Accordingly, in either scenario, the handle of the light stick is a conduit to receive an illuminated or illuminable light stick.

Figure 6:
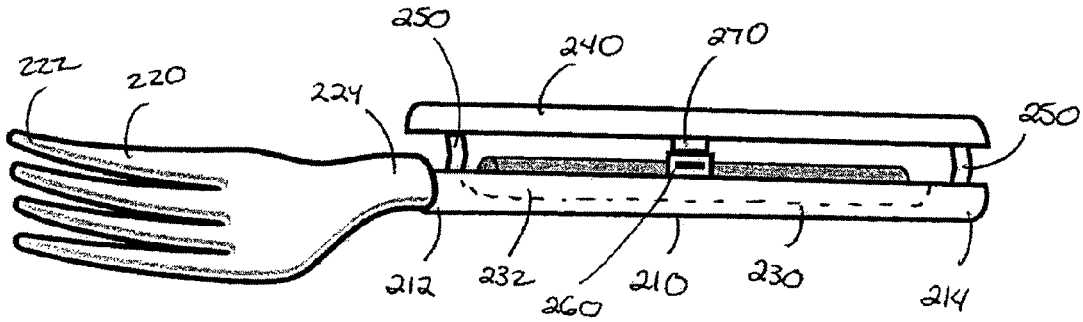
FIG. 6 is a perspective view of a utensil with a handle in the form of a split conduit.

FIG. 6 is a perspective view of another embodiment of a utensil (200) modified to receive a chemiluminescent light stick. As shown, the utensil includes a head (220) having a proximal end (222) and a distal end (224), and an elongated handle (210) having a proximal end (212) and a distal end (214). The proximal end (212) of the handle (210) is adjacent to the distal end (224) of the head (220). The head (220) and handle (210) may be detachable as shown in FIG. 1, or they may be formed as a single cohesive unit. In either formation, the handle (210) is in the form of a split conduit having a first portion (230) and a second portion (240). The first portion (230) and the second portion (240) may be held together by an attachment element (250), such as a hinge (250) or a tether (not shown). The purpose of the hinge (250) is to hold the first and second portions (230) and (240), respectively, in a spaced relationship prior to insertion or removal of the light stick from the conduit (210). Both portions of the split conduit (210) have a concave groove (232) and (242), respectively, with each groove sized to receive a chemiluminescent light stick. The first and second portions (230) and (240), respectively, may be the same size or different sizes. Regardless of the size of the portions (230) and (240), one of the grooves (232) or (242), respectively, is sized to receive the light stick, and following placement of the light stick in one of the grooves (232) or (242), the other portion of the conduit (210) and the associated groove covers the remaining exposed portion of the light stick. In addition to the grooves (232) and (242), each portion (230) and (240) of the conduit (210) preferably includes an attachment mechanism (260) and (270) to hold the portions (230) and (240) of the conduit (210) in a closed position thereby preventing removal of the light stick from the conduit (210). For example, the attachment mechanism (260) may be in the form of a male extension (270) on the second portion (240) that is adapted to be received by a female receiving element (260) on the first portion (230). Accordingly, the utensil includes a head, and a handle in the form of a split conduit with a groove therein sized to receive a chemiluminescent light stick.

In relation to the embodiment shown in FIG. 6, the light stick may be flexed to initiate the chemical reaction and then inserted into the handle (210) followed by attachment of the first and second portions (230) and (240) of the handle (210). However, in one embodiment, the handle (210) may have sufficient flexibility to enable a person to insert the light stick into the handle prior to initiating a chemical reaction. For example, the light stick may be placed in the groove (232) of the first portion (234) of the handle (210), followed by closing the first portion (230) with the second portion (240) to form the handle (210), wherein the groove (242) of the second portion (240) of the handle encloses the light stick. Once the first and second portions (230) and (240) of the handle (210) are in a closed position, the person may flex the handle (210) with the light stick therein.

Figure 7A:
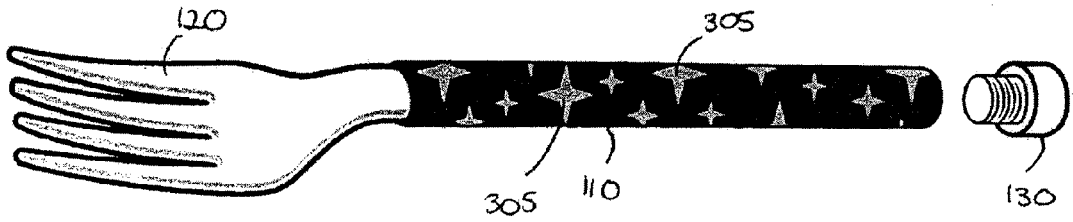
FIGS. 7A, 7B, and 7C are each a perspective view of a utensil with translucent material.
Figure 7B:
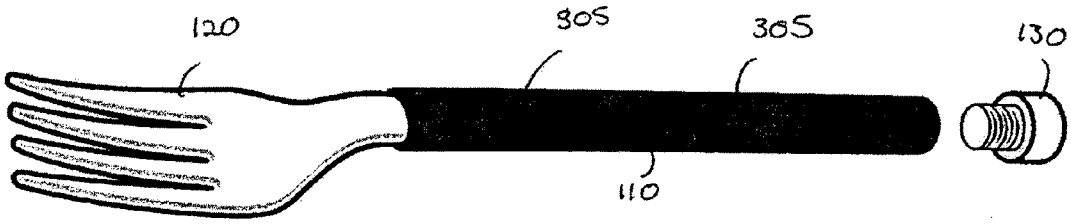
Figure 7C:
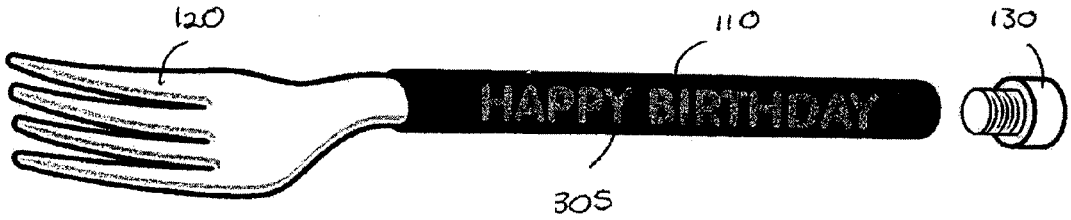

In each of the embodiments of the invention wherein the handle of the utensil is in the form of a conduit for receiving the light stick, the conduit is made from a material that enables the light to be transmitted. For example, the conduit and/or external skin of the light stick may be made of a transparent or translucent material, as shown in FIGS. 7*a*, 7*b*, and 7*c*. The transparent material portions may be made of shapes so that as light is transmitted through the transparent portions (305), a person would see shapes of color along the conduit. In addition, the material of the handle and/or the utensil head may be made from the same material or from dissimilar materials if they are detachable. The material of either the handle or the utensil head may be plastic or metallic. Since there are no batteries or electronic circuitry, the handle and/or utensil head portions may be reused following a cleaning process. Similarly, in the embodiments where the handle is a conduit, the light stick may be replaced with another light stick. This may be desirable when the emission of light of the light stick in the conduit expires, or if a user of the utensil desires to transmits a different color. In the embodiment where the light stick forms the handle of the utensil, the user merely detaches the light stick from the head when the emission of light of the light stick expires, or if a user of the utensil desires to transmit a different color. Accordingly, the use of light sticks associated with utensils provides a lot of flexibility for changing color emission or replacing an expired or expiring light stick.

Advantages Over the Prior Art

A utensil that can be illuminated with a chemiluminescent light stick emits light for a limited duration without the use of a battery and electronic circuitry. Either the head or handle of the utensil is modified to receive the chemiluminescent light stick. Employment of the light stick mitigates issues associated with heat byproduct from battery and electronic circuitry. More specifically, it is known in the art that use of a battery or electronic circuitry produces a heat byproduct, and when used with a utensil may not be functional. For example, use of a battery or electronic circuitry for a food item utensil may cause melting or spoiling of the adjacent food item at a faster pace than desired. Similarly, for a writing utensil, the battery or electronic circuitry may be excessive and burn the person holding the utensil. Accordingly, the employment of the chemiluminescent light stick for a utensil mitigates all issues with respect heat byproduct.

As described above, in one embodiment the light stick becomes the handle of the utensil, and in another embodiment, the handle is a conduit sized to receive a light stick. The lights stick in each of the embodiments is replaceable at the discretion of the user. The employment of the burr(s) functions to provide a frictional fit of the light stick to the utensil head without rupturing the skin of the light stick, while providing a releasable engagement between the utensil head and the handle, i.e. light stick. Accordingly, the light stick may function as a replaceable element of the utensil.

Alternative Embodiments

It will be appreciated that, although specific embodiments of the invention have been described herein for purposes of illustration, various modifications may be made without departing from the spirit and scope of the invention. In particular, the illuminating handle with a utensil head may be expanded to include a writing utensil, such as a pencil or pen. The ink or lead for the writing implement would be in the head of the utensil, and the handle either is a chemiluminescent light stick, or a conduit adapted to receive the chemiluminescent light stick. Accordingly, the scope of protection of this invention is limited only by the following claims and their equivalents.

The invention claimed is:

1. An apparatus comprising:

a detachable utensil head having a proximal end and a distal end, said utensil head is selected from a group consisting of: a fork, a spoon, and a knife;

a chemiluminescent stick having a proximal end and a distal end;

the proximal end of the utensil head having a hollow interior section sized to receive the proximal end of the chemiluminescent light stick, the distal end of the chemiluminescent light stick being absent any secured connections;

the hollow interior section of the utensil head having at least one burr formed on an interior surface of the utensil head to hold the proximal end of the chemiluminescent light stick in the hollow interior section;

said proximal end of said chemiluminescent stick being releasably engageable with said proximal end of said detachable utensil head, wherein said proximal end of said chemiluminescent stick removably inserts into an annular groove of said proximal end of said detachable utensil head to form a utensil; and a portion of the chemiluminescent stick extending outside of said annular groove to the distal end and being absent a secondary enclosure.

2. The apparatus of claim 1, further comprising at least two burrs formed on the interior surface of the utensil head.

3. The apparatus of claim 1, wherein said at least two burrs are on opposite sides of the hollow interior section of the utensil head.

4. The apparatus of claim 1, wherein said chemiluminescent stick is created from material selected from a group consisting of: transparent, translucent, and combinations thereof.

5. The apparatus of claim 1, wherein said utensil head is created from material selected from a group consisting of: metallic, plastic, and combinations thereof.

6. The apparatus of claim 1, further comprising said portion of the chemiluminescent stick extended outside of said annular groove to the distal end of the chemiluminescent stick forming a utensil handle.

7. An apparatus comprising:

a detachable utensil head having a proximal end and a distal end, said utensil head is selected from a group consisting of: a fork, a spoon, and a knife;

a handle in the form of a chemiluminescent stick having a proximal end, a distal end, and a middle portion between the distal and proximal ends;

the proximal end of the utensil head having a hollow interior section sized to receive the proximal end of the chemiluminescent light stick, the distal end of the chemiluminescent light stick absent any secured connections;

the hollow interior section of the utensil head having at least one burr formed on an interior surface of the utensil head to hold the proximal end of the chemiluminescent light stick in the hollow interior section; and said proximal end of said chemiluminescent stick being releasably engageable with said proximal end of said detachable utensil head, wherein said proximal end of said chemiluminescent stick removably inserts into an annular groove of said proximal end of said detachable utensil head thereby forming a utensil.

8. The apparatus of claim 7, further comprising the middle portion of the chemiluminescent stick extending outside of said annular groove to the distal end absent a secondary enclosure.

9. The apparatus of claim 8, further comprising the middle and distal portions of the chemiluminescent light stick being the handle.

* * * * *